US005090831A

United States Patent [19]

Kageyama et al.

[11] Patent Number: 5,090,831

[45] Date of Patent: Feb. 25, 1992

[54] WRITING INSTRUMENT

[75] Inventors: Hidehei Kageyama; Yoshihide Mitsuya; Youichi Nakazato, all of Saitama, Japan

[73] Assignee: Kotobuki & Co., Ltd., Kyoto, Japan

[21] Appl. No.: 625,489

[22] Filed: Dec. 11, 1990

Related U.S. Application Data

[62] Division of Ser. No. 377,271, Jul. 10, 1989, Pat. No. 5,018,891.

[51] Int. Cl.[5] ..... B43K 29/02

[52] U.S. Cl. ..... 401/52; 401/29; 401/75; 401/86; 15/429; 15/433

[58] Field of Search ..... 401/52, 75, 68, 69, 401/79, 65, 19, 29, 86, 78; 15/429, 431, 433

[56] References Cited

U.S. PATENT DOCUMENTS 2,613,643 10/1952 Merryman ..... 401/76

3,216,563 11/1965 Finkenzeller ..... 401/76

*Primary Examiner*—Danton D. DeMille

*Attorney, Agent, or Firm*—Sherman and Shalloway

[57] ABSTRACT

A writing instrument wherein a rear cap is rotatably connected through a connector to a rear end of an outer tube into which a core pipe is axially slidably inserted, a guide member for an eraser is axially slidably inserted into the rear cap for axial engagement, a spiral member is spirally connected to an eraser receiving member which supports an eraser axially slidably inserted into a spiral member for axial engagement, the spiral member having a front end axially slidably connected to the connector for axial engagement, and the eraser guide member is urged in a withdrawing direction by means of an elastic body so that the guide member is held at a fixed projected position during non-knocking.

2 Claims, 6 Drawing Sheets

WRITING INSTRUMENT

This is a division of application Ser. No. 07/377,271, filed July 10, 1989 now U.S. Pat. No. 5,018,891.

BACKGROUND OF THE INVENTION

1. Field of the Invention

This invention relates to a writing instrument comprising a combination of means for drawing out an eraser and a writing portion.

2. Description of the Prior Art

In a writing instrument such as a conventional knocking type mechanical pencil, in which a rear cap is axially movably connected to a rear end of an outer tube, a lead pipe is axially slidably inserted into the interior formed by both the outertube and the rear cap, an eraser of which rear end is caulked by a metal annulus is detachably fitted and held on the lead pipe, and the rear cap is knocked through the eraser whereby the lead pipe is axially moved accordingly to feed a lead. The eraser is used by removing an eraser cap from the rear cap.

In such a conventional writing instrument as mentioned above, the whole relatively lengthy rear cap on the extension coaxial with the outer tube has to be knocked when lead is fed. Therefore, there has been a problem in that at the time of knocking, the rear cap is caught by a hand holding the pencil, rendering knocking difficult.

The eraser is always held and fixed in position, and the length thereof projected from the caulked metal annulus is short in view of the strength of the eraser itself. In addition, the amount of drawing the eraser cannot be adjusted according to the degree of consumption, resulting in a problem in that the degree of consumption of the eraser is severe and the eraser soon becomes unsuitable for use.

In view of the foregoing, the present applicant has solved the aforesaid problems by a writing instrument disclosed in Japanese Utility Model Application Laid-Open Publication No. 63-63489 previously filed.

This writing instrument is designed so that when a rear cap connected to a rear end of an outer tube is rotated, an eraser is fed out by the screw feed action, and a knocking cap inserted axially slidably into the rear cap and extended outwardly of the rear end is knocked to thereby feed a lead.

However, the above-described writing instrument has a problem in that when the eraser is fed by rotation of the rear cap after the knocking cap has been knocked, the knocking cap is also moved therewith. Therefore, an engaging rib is provided. However, in the case where the friction between the eraser and the knocking cap is greater than the engaging rib, there remains a problem in that the knocking cap is moved, resulting in a lowering of reliability during mass production.

SUMMARY OF THE INVENTION

A primary object of this invention is to provide a writing instrument in which a knocking cap can be held at a fixed rear projected position during non-knocking, and movement of the knocking cap during drawing-out of an eraser can be positively prevented, while overcoming the problems noted as described above with respect to prior art.

A further object of this invention is to provide a connector for a writing instrument for rotatably connecting an outer tube and a rear cap.

Another object of this invention is to provide an apparatus for drawing out an eraser for a writing instrument in which the eraser can be smoothly and positively drawn out and withdrawn, and further easily assembled.

In a writing instrument according to this invention, a rear cap is rotatably connected through a connector to a rear end of an outer tube into which a core pipe is axially slidably inserted, a guide member for an eraser is axially slidably inserted into the rear cap for axial engagement, a spiral member is spirally connected to a receiving member for an eraser which supports an eraser axially slidably inserted into a spiral member for axial engagement, said spiral member having a front end axially slidably connected to said connector for axial engagement, and said guide member for an eraser is urged in a withdrawing direction by means of an elastic body so that said guide member is held at a fixed projected position during non-knocking.

In a connector according to this invention, a rear end thereof is fitted in an outer tube whereas a fore end thereof is rotatably connected to a rear cap, said outer tube and said rear cap being rotatably connected.

In an apparatus for drawing out an eraser, there is provided a receiving member for an eraser which is drawn out and withdrawn along a spiral member while being guided by a guide groove of a guide member for an eraser, said receiving member for an eraser being formed with a holding portion for an eraser and a deformed portion.

Further upon revolving actuation of the eraser guide member, the eraser receiving member has a bend in the diametrical direction of the protrusion so that the deformable portion of the eraser receiving member may be deformed in the diametrical direction to absorb deviation of the eraser guide member in a diametrical direction and deviation of the internal diameter of the rear cap accordingly. As the result, there can be precisely performed the propelling and retracting actuation of the eraser.

Furthermore, there can be prevented, in advance, the breakage of the eraser receiving member and of the projection thereof due to the bend set forth above and thereby propelling and retracting actuation is always performed smoothly and precisely.

Other objects and advantages of this invention will become more apparent from the ensuing detailed description of embodiments with reference to the accompanying drawings.

PREFERRED EMBODIMENTS OF THE INVENTION

Embodiments of this invention will be described hereinafter with reference to the drawings.

The writing instruments used in this invention include a mechanical pencil, a ball point pen or the like. For convenience's sake, a case where this invention is applied to a mechanical pencil will be described hereinafter.

Figure 1:
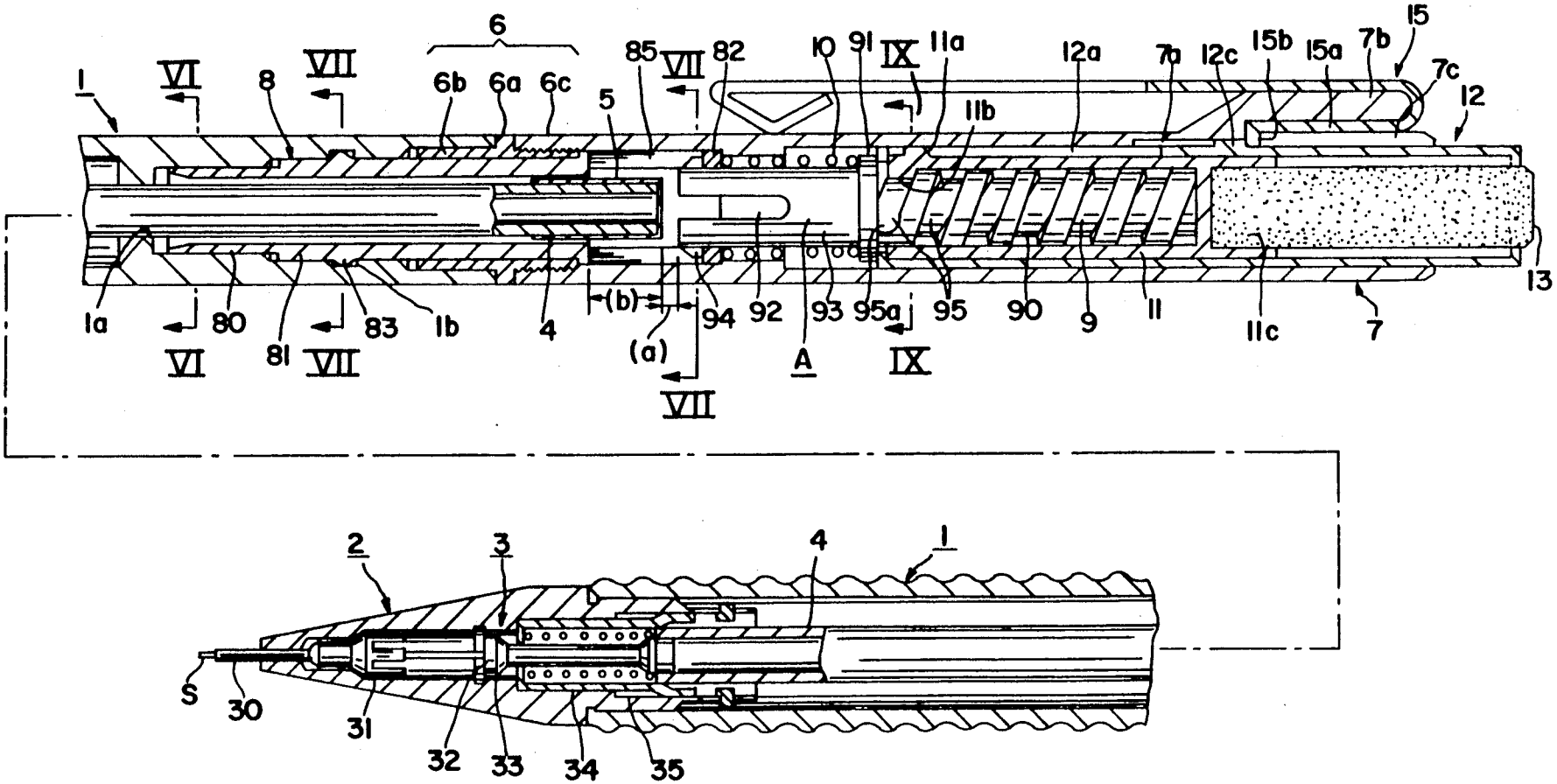
FIG. 1 is a sectional view of a knocking type mechanical pencil according to one embodiment of this invention.
Figure 4:
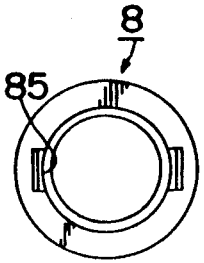
FIG. 4 is a right end view of FIG. 2.

In a knocking type mechanical pencil shown in FIG. 1, the fore means 2 is detachably connected to the fore end of an outer tube 1 by means such as a screwing.

A lead draw-out mechanism 3 as a writing portion is incorporated into the fore means 2, and a fore end of a lead pipe 4 is connected to the lead draw-out mechanism 3.

Thereby, the lead draw-out mechanism 3 and the lead pipe 4 are integrally unified with the fore means 2.

In the midst of an inner peripheral surface of the outer tube 1, there is coaxially provided an annular lead-pipe holding portion la having a small diameter and difference in level.

The lead pipe holding portion 1*a* coaxially holds axially slidably the lead pipe 4 in the state wherein said pipe 4 is inserted into the outer tube 1 when a rear cap 7 later described is removed, to prevent the lead pipe 4 from being inclined.

The lead draw-out mechanism 3 comprises a fore pipe 30 moved out and in the fore end of the fore means 2, a friction applying member 31 for applying a frictional engaging force to a lead S drawn out through the interior of the fore pipe 30, a lead chuck 32 connected to the fore end of the lead pipe 4, a chuck fastening ring 33 for fastening the chuck, a cushion sleeve 34 axially slidably inserted into the rear side of the fore means 2 and having a front end in contact with a rear end of the chuck fastening ring 33, and a chuck fastening elastic body 35 for urging the chuck fastening ring 33 forwardly through the cushion sleeve 34 and urging the lead chuck 32 rearwardly together with the lead pipe 4.

Accordingly, the fore means 2 is connected to the fore end of the outer tube 1 whereby the lead pipe 4 unified with the fore means 2 is axially slidably inserted into the outer tube 1.

In this state, the rear end of the lead pipe 4 extended out of the rear end of the outer tube 1.

A cap 5 is detachably capped on the rear end of the lead pipe 4 to prevent the lead S received therein from being slipped out.

This cap 5 comprises, for example, an extremely thin cylindrical body coated with chrome plating.

In such an extremely thin cylindrical cap 5, only the extremely thin portion at the rear end thereof corresponds to the net projecting length from the rear end of the lead pipe 4. This projecting length can be almost ignored with respect to the length of the whole writing instrument, and therefore the length of the whole writing instrument can be shortened. Furthermore, if a rear cap 7 detachably connected to the rear end of the lead pipe 4 through an intermediate ring 6 is removed, the whole cap 5 is exposed, entirety of which forms a gripping allowance. Therefore, the cap 5 can be easily removed and a replenishment of a lead to the lead pipe 4 can be easily carried out.

The intermediate ring 6 comprises an outer collar portion 6*a* provided in the intermediate portion of the outer peripheral surface thereof, a front tubular portion 6*b* and a rear tubular portion 6*c* with the outer collar portion 6*a* being a border. The rear tubular portion 6*c* is screwed into the front end of the rear cap 7, and the outer collar portion 6*a* is rotatably connected to the connector 8.

The connector 8 according to a second embodiment rotatably connects an outer tube 1 and a rear cap 7 fitted in the intermediate ring 6, the connector 8 being locked to the outer tube 1. As shown in FIGS. 1 to 5, the connector 8 is integrally formed into a stepped tubular configuration which gradually stepwisely increases in diameter from the front end toward the rear end, and comprises a front-stage tubular portion 80, a middle-stage tubular portion 81 and a rear-stage tubular portion 82.

In the connector 8, in the outer peripheral surface of the middle-stage tubular portion 81 is integrally projected an engaging projection 83 (see FIGS. 1 to 5, and FIG. 7) fitted in and engaged with an engaging recess 1*b* (see FIG. 1) provided in the inner peripheral surface at the rear of the outer tube 1.

One or more axial slits 84 are provided in the engaging projection 83 of the middle-stage tubular portion 81. The engaging projection 83 and the slits 84 are provided on a perpendicular sectional line of the middle-stage tubular portion 81.

The intermediate ring 6 is rotatably fitted in the middle-stage tubular portion 81 as shown in FIG. 1.

At the fitting of the intermediate ring 6, the middle-stage tubular portion 81 is flexed in a direction of reducing a diameter by the slits 84, thus facilitating the fitting of the intermediate ring 6.

The rear tubular portion 6 of the intermediate ring 6 is screwed into the front end of the rear cap 7 whereby the rear end of the connector 8 is coaxially connected to the front end of the rear cap 7.

Thereby, the intermediate ring 6 and the connector 8 are unified in the front end of the rear cap 7.

The connector 8 is fitted into the rear side of the outer tube 1 from the side of the front-stage tubular portion 80 while inserting the rear end of the lead pipe 4 within the outer tube 1 into the connector 8. The front tubular portion 6*b* of the intermediate ring 6 is fitted into the rear end of the outer tube 1 whereby the outer tube 1 and the rear cap 7 are coaxially rotatably connected.

The intermediate ring 6 is rotatable with respect to the outer tube 1 and the connector 8, and is connected integrally by a threaded connection or the like to the rear cap 7.

Accordingly, the outer tube 1 and the rear cap 7 are coaxially rotatably connected as mentioned above.

In this connected state, the rear end of the lead pipe 4 is projected rearwardly from the rear end of the connector 8, whereby the lead pipe 4 can be knocked by a knocking shaft 93 later described through the cap 5.

In the aforesaid connected state, the connector 8 is engaged within the outer tube 1 for axial engagement.

Figure 2:
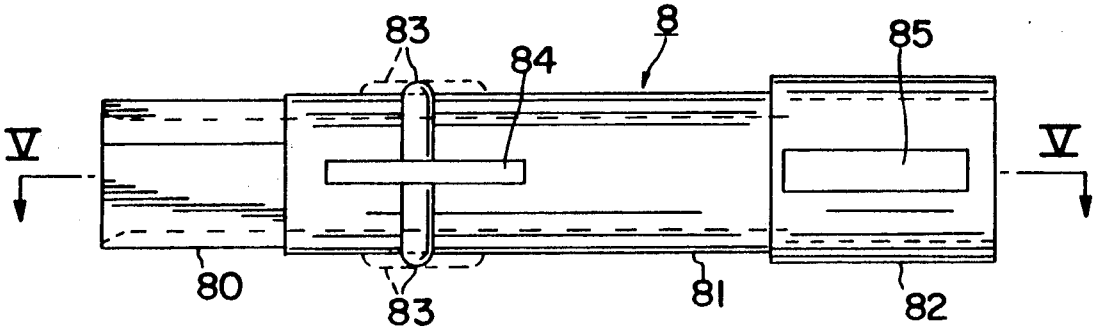
FIG. 2 is a plan view of a connector.
Figure 5:
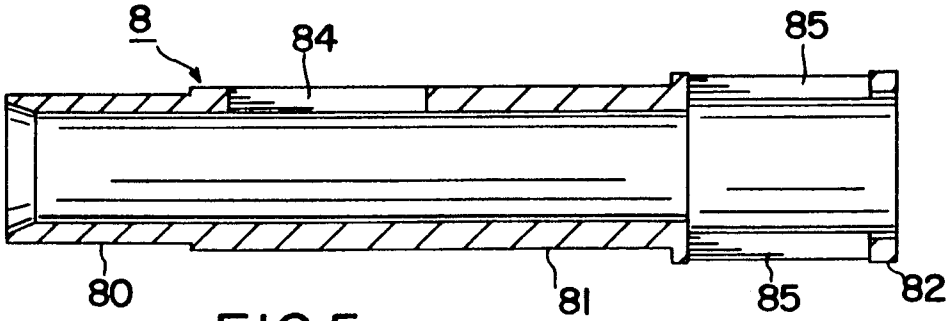
FIG. 5 is a sectional view taken on line V—V of FIG. 2.
Figure 3:
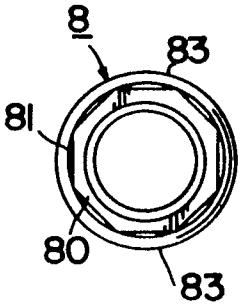
FIG. 3 is a left end view of FIG. 2.
Figure 6:
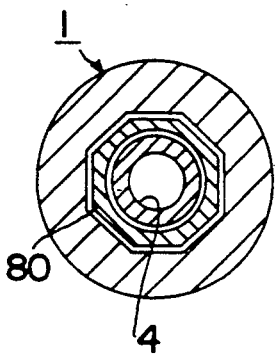
FIG. 6 is a sectional view taken on line VI—VI of FIG. 1.
Figure 7:
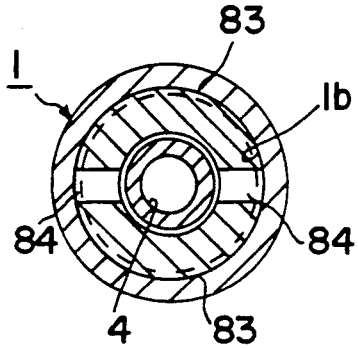
FIG. 7 is a sectional view taken on line VII—VII of FIG. 1.
Figure 8:
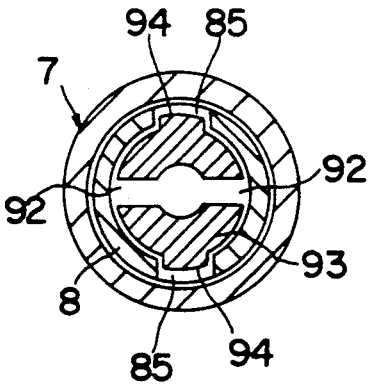
FIG. 8 is a sectional view taken on line VIII—VIII of FIG. 1.

As the engaging means, the outer peripheral surface of the front-stage tubular portion 80 and the inner peripheral surface at the rear end of the outer tube 1 are respectively formed into an octagonal sectional shape as shown in FIGS. 2, 3 and 6 and are mutually fitted and engaged. It is noted that their shapes may be of other polygonal shapes.

In the middle-stage tubular portion 81 of the connector 8, the engaging projection 83 is fitted and engaged with an engaging recess lb (see FIGS. 1 and 7) of the outer tube 1.

At the fitting, that is, even when the connector 8 is inserted into the outer tube 1, the connector 8 is elastically deformed in a direction of reducing a diameter by the slits 84 whereby the insertion of the connector 8 and the fitting and engagement of the engaging projection 83 with respect to the engaging recess 1*b* can be easily carried out.

As described above, the outer tube 1 and the connector 8 are mutually axially engaged over two stages, thus obtaining a sufficient mutual fitting force.

Therefore, the outer tube 1 and the rear cap 7 are not mutually rotated more than as needed.

The engaging projection 83 may be formed lengthwise in an axial direction of the outer peripheral surface of the middle-stage tubular portion 81 as shown by the dash-dotted contour lines in FIG. 2. In this case, the outer tube 1 is not formed with the engaging recess 1*b* but the engaging projection 83 is brought into pressure contact with the inner peripheral surface of the outer tube 1 by making use of flexure of the slits 84 of the middle-stage tubular portion 81 in a direction of reducing a diameter whereby a sufficient fitting force therebetween can be obtained. Furthermore, the engaging recess 1*b* need not be formed, and the portion need not be forcibly molded, imposing a burden on the mold.

At a symmetrical position of the peripheral wall of the rear-stage tubular portion 82 of the connector 8 is provided an axial sliding groove 85 as shown in FIGS. 1, 2, 5 and 8.

The axial sliding groove 85 axially slidably fits and engages a front engaging projection 94 of a spiral member 9, which forms one element of an eraser draw-out apparatus A according to a third embodiment later described for axial engagement of the spiral member 9. It is to be noted that the engaging means is not limited to the aforesaid axial sliding groove 85 but any other means may be employed in which the front engaging projection 94 of the spiral member 9 is axially engaged within the rear-stage tubular portion 82 of the connector 8.

As shown in FIG. 1, the front end of the spiral member 9 is axially slidably connected to the rear-stage tubular portion 82.

The eraser draw-out apparatus A according to the third embodiment comprises a spiral member 9, an eraser guide member 12, and an eraser receiving member 11 arranged slidably with respect to a guide groove 12*a* of the eraser body guide member 12.

The spiral member 9 comprises a spiral shaft portion 90 for drawing out the eraser, a connection shaft portion (knocking shaft) 93 coaxially integrally connected to the front end of the spiral shaft portion 90 through a cylindrical collar-like stopper shoulder 91 and formed into a two-divided cylindrical configuration capable of being spread and reduced in a diametral direction by a cut slit 92 on the front end side, and a front end engaging projection 94 integrally projected on the outer peripheral surface of the front end of the connection shaft portion 93.

In the spiral member 9, its connection shaft portion 93 is reduced in a diametral direction and inserted into the rear-stage tubular portion 82 of the connector 8, and the front end engaging projection 94 is fitted and engaged in the axial sliding groove 85 of the rear-stage tubular portion 82 by the elastic restoring force of the connection shaft portion 93.

The spiral member 9 is urged rearwardly by the elastic body 10 interposed between the stopper shoulder 91 at the rear end of the connection shaft portion 93 and the rear end of the rear-stage tubular portion 8 of the connector 8.

Thereby, the spiral member 9 is axially slidably connected to the rear end of the connector 8 to unify both the members.

A distance (a) is formed between the rear end of the lead pipe cap 5 and the fore end of the connection shaft portion 93.

This distance (a) comprises a cushion stroke in the cushion mechanism of the lead S. Even in a normal knocking type writing instrument having no cushion mechanism, the distance (a) or a slight clearance is inevitably required in view of unevenness of the overall length.

That is, when the distance (a) is absent, a head of the lead pipe cap 5 comes into contact with the connection shaft portion 93, which is just in a knocked state. This leads to a lead slip during writing, completely being useless as a writing instrument.

A distance (b) is formed between the rear end of the lead pipe cap 5 and the rear end of the connector 8.

This distance (b) is a knocking allowance in which the spiral member 9 is moved forward by rear-end knocking later described, the rear end of the lead pipe 4 is pressed and moved by the fore end of the connection shaft portion 93 through the cap 5, and the lead pipe 4 is moved forward whereby the lead S is fed out of the end pipe 30.

A spiral shaft portion 90 of the spiral member 9 is axially movably inserted and engaged in an eraser receiving base 11 in the form of a cylindrical eraser receiving member.

The eraser receiving base 11 is axially slidably inserted for axial engagement into a knocking cap 12 in the form of an eraser guide member inserted into the rear cap 7.

As the engaging means, a projection 11*a* integrally projected in the outer peripheral surface on the front end of the eraser receiving base 11 is fitted and engaged in a guide groove 12*a* provided in the knocking cap 12.

Figure 9:
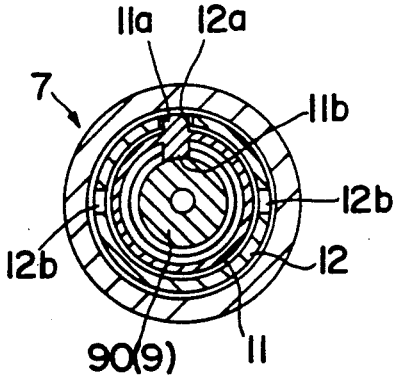
FIG. 9 is a sectional view taken on line IX—IX of FIG. 1.
Figure 12:
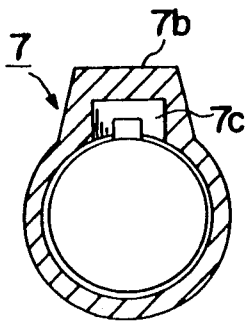
FIG. 12 is a sectional view taken on line XII—XII of FIG. 10.
Figure 10:
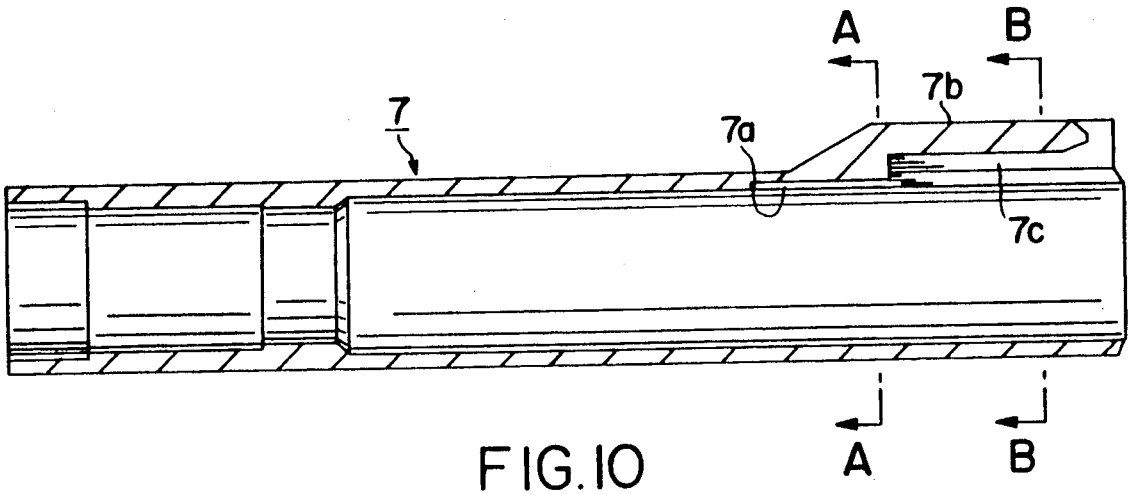
FIG. 10 is a sectional view of a rear cap.
Figure 11:
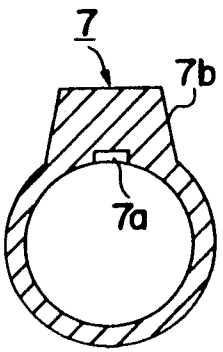
FIG. 11 is a sectional view taken on line XI—XI of FIG. 10.
Figure 14:
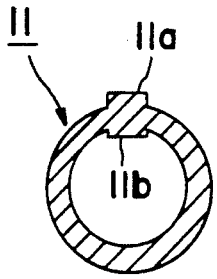
FIG. 14 is a sectional view taken on line XIV—XIV of FIG. 13.
Figure 17:
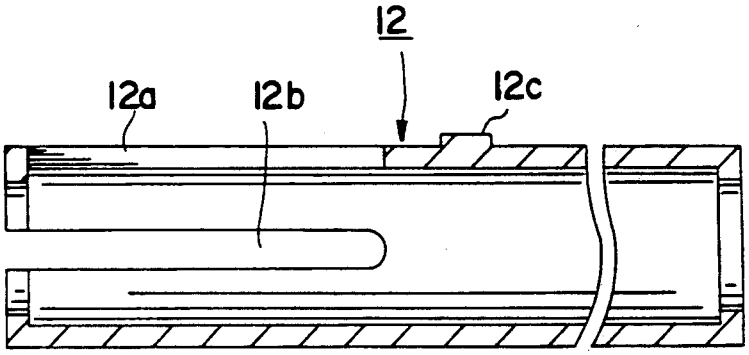
FIG. 17 is a sectional view of a guide member for an eraser.

On the front end side of the knocking cap 12, an axial cut slit 12*b* is provided on a perpendicular sectional line with the guide groove 12*a* as shown in FIGS. 9 and 17. With the structure as described above, assembling may be facilitated. That is, in insertion of the projection 11*a* of the eraser receiving base 11 into the guide groove 12*a* of the knocking cap 12, the knocking cap 12 is elastically deformed in a diametral (inward and or outward) direction at the cut slit 12*b* whereby the insertion can be easily done. In addition, after insertion, the cut slit 12*b* is elastically restored in a direction of reducing a diameter whereby the projection 11*a* and the guide groove 12*a* are positively fitted and engaged.

Secondly, drawing-out and withdrawal of the eraser receiving base 11 can be made smoothly. That is, even if the projection 11*a* is flexed in a diametral direction when the inward engaging pawl 11*b* of the eraser receiving base 11 is moved in a direction of draw-out and withdrawal along the spiral groove 95 of the knocking cap 9, the flexure can be absorbed by the expansion of the cut slit 12*b*. Therefore, the movement of the eraser receiving base 11 can be done smoothly.

Figure 15:
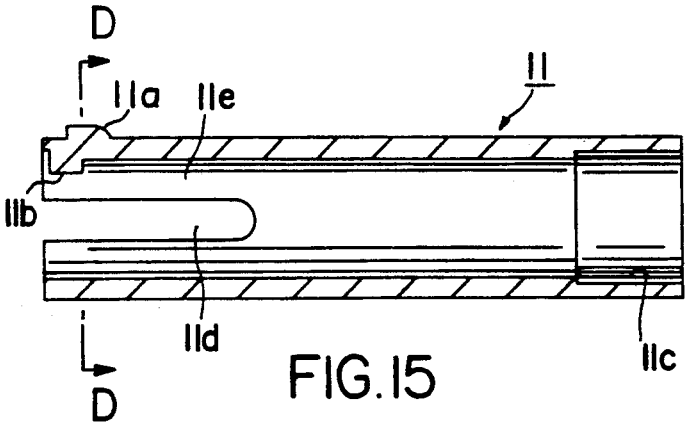
FIG. 15 is a sectional view showing a further embodiment of the receiving member for an eraser.
Figure 16:
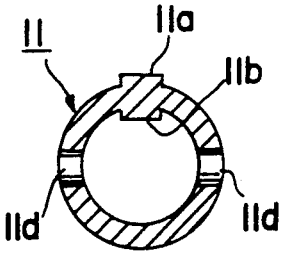
FIG. 16 is a sectional view taken on line XVI—XVI of FIG. 15.

In FIGS. 15 and 16, a cut slit 11*d* is formed, in which case the cut slit 12*b* of the knocking cap 12 may be omitted. By the provision of the cut slit 11*d*, the eraser receiving base 11' will have a deformable deformable portion 11*e*, which is formed with a projection 11*a*.

The deformable portion 11*e* is formed with the projection 11*a* as just mentioned above to thereby facilitate assembling. That is, similarly to the above, in insertion of the projection 11*a* of the eraser receiving base 11' into the guide groove 12*a* of the knocking cap 12, the cap is elastically deformed in a diametral (inward and or outward) direction of the deformable portion 11*e* of the eraser receiving base 11' to thereby facilitate the insertion. After insertion, the deformable portion 11*e* is elastically restored in a diametral direction whereby the projection 11*a* and the guide groove 12*a* are positively fitted and engaged.

Secondly, the drawing-out and withdrawal of the eraser receiving base 11' are accomplished extremely smoothly. That is, even if the projection 11*a* is flexed and bent in a diametral direction to produce an action to impede the smooth movement of the eraser receiving base 11' such as vibrations when the inward engaging pawl 11*b* of the eraser receiving base 11 is moved in a direction of drawing out and withdrawal along the spiral groove 95 of the knocking cap 9, these can be absorbed by being deformable by the deformed portion 11*e* of the eraser receiving base 11'. Therefore, the movement of the eraser receiving base 11' is effected smoothly and positively.

The inward engaging pawl 11*b* is integrally provided in the inner peripheral surface on the front end side of the eraser receiving base 11', 11' the inward engaging pawl 11*b* being feedably fitted and engaged in the spiral groove 95 of the spiral shaft portion 90.

Thereby, the eraser receiving base 11, 11' is feedably connected to the spiral member 9.

When the front end of the eraser receiving base 11, 11' comes into contact with the rear end of the stopper shoulder 91 of the spiral shaft portion 90, a pitch is set to 0 in the outer periphery of the front end 95*a* of the spiral groove 95.

Therefore, in the state where the inward engaging pawl 11*b* engages the front end 95*a* of the spiral groove 95, even if the eraser receiving base 11, 11' is forcibly turned in the engaging direction, the stopper strength corresponding thereto is obtained so that the inward engaging pawl 11*b* is not bit into the front end 95*a* of the spiral groove 95.

An eraser fitting hole portion 11*c* in the form of a gripping portion is provided interiorly on the rear end side of the eraser receiving base 11, 11' a base of the eraser 13 is detachably fitted and supported within the fitting hole portion 11*c*. A rib having a triangular section, for example, is provided in the inner peripheral surface of the fitting hole portion 11*c*. This rib may be bit into the eraser 13 to prevent the eraser 13 from being slipped out at random.

Figure 13:
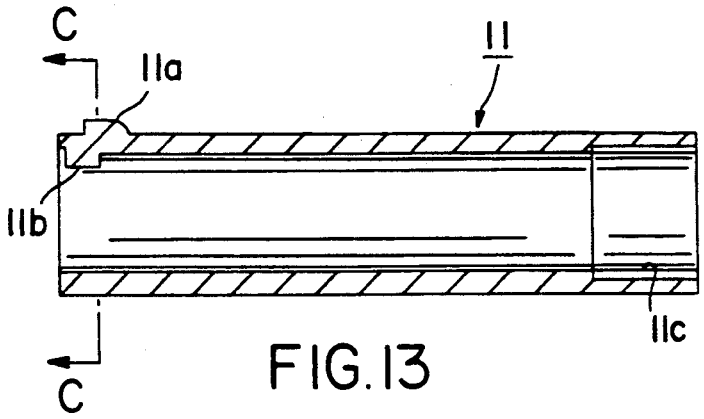
FIG. 13 is a sectional view of a receiving member for an eraser.
Figure 18:
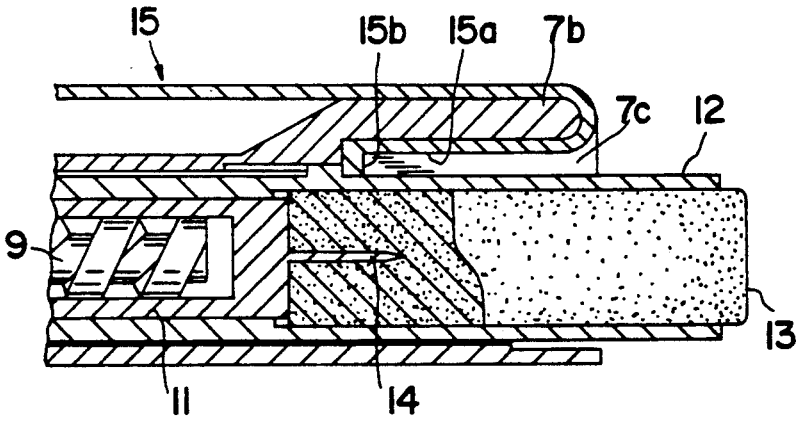
FIG. 18 is a sectional view showing a further embodiment of the receiving member for an eraser.

As shown in FIG. 18, as the anti-slipout means, an insert needle 14 in the form of a gripping portion may be formed integral with or mounted by a separate part in the center portion at the rear end of the eraser receiving base 11', and the eraser 13 may be inserted and supported on the insert needle 14. In this case, the eraser fitting hole portion 11*c* shown in FIGS. 1, 13 and 15 may be omitted, whereby a space may be secured and eraser having a larger diameter can be mounted, placing the instrument in more usable condition.

On the other hand, the knocking cap 12 is engaged in the rear cap 7 for axial engagement.

As the engaging means, an engaging projection 12*c* projected integral with the outer peripheral surface of the knocking cap 12 is axially slidably engaged with an axial engaging groove 7*a* provided in the inner peripheral surface of the rear cap 7. Alternatively, the engaging projection 12*c* is projected integrally on the inner peripheral surface of the rear cap 7 and the axial engaging groove 7*a* is provided in the outer peripheral surface of the knocking cap 12 to provide the engaging means. A clip 15 is mounted on the rear cap 7.

A raised wall portion 7*b* for mounting a clip is integrally formed on the outer peripheral surface at the rear of the rear cap 7 as shown in FIG. 1 and FIGS. 10 to 12, the raised wall portion 7*b* being provided with a clip inserting groove 7*c*. The inside of the clip inserting groove 7*c* is open into the rear cap 7.

The clip inserting groove 7*c* comprises a molded groove integrally formed by a molding pin when the rear cap 7 is molded, and the clip 15 is mounted by use of the molded groove.

On the side of the base end of the clip 15, an inserting element 15*a* is bent back into an approximately U-shape, and an engaging element 15*b* which is further inwardly bent substantially at right angles is provided on the fore end of the inserting element 15*a*.

The inserting element 15*a* is pressed into the clip inserting groove 7*c*, whereby the base portion of the clip 15 is mounted on the raised wall portion 7 of the rear cap 7.

In the mounting state as described above, the inserting element 15*a* of the clip 15 is pressed in engagement with the clip inserting groove 7*c*, and the engaging element 15*b* extends into the rear cap 7 through the clip inserting groove 7*c* and comes into sliding contact with the outer peripheral surface of the knocking cap 12.

The knocking cap 12 is urged in a direction of withdrawal by the elastic body 10 through the rear end of the stopper shoulder 91 of the spiral shaft portion 90 which is in pressure contact with the front end thereof, whereby the rear end of the engaging projection 12*c* of the knocking cap 12 engages the front end of the engaging element 15*b* of the clip 15.

Accordingly, the engaging element 15*b* of the clip 15 defines the backward movement of the knocking cap 12 to prevent the knocking cap 12 from being slipped out and holds the knocking pin 12 at a fixed rearwardly projected position during non-knocking.

The slipping out of the knocking pin 12 is prevented by the clip 15 whereby an anti-slipout screw or the like need not be provided at the rear end of the rear cap 7, thus reducing the number of parts, and reducing the defective percentage of writing instrument products to reduce the cost.

In the clip 15, the inserting element 15*a* may be merely inserted into the clip inserting groove 7*c*. Therefore, assembling is simple.

In the elastic body 10, the knocking cap 12 may be merely urged in a direction of withdrawal, and therefore, a weak elastic force thereof will suffice.

In assembling a writing instrument, the fore means 2 having the lead draw-out mechanism 3 and the lead pipe 4 integrally unified is connected to the fore end of the outer tube 1.

On the other hand, when the projection 11*a* of the eraser receiving base is forced into the knocking cap from the front end direction of the knocking cap while adjusting to the guide groove 12*a* thereof, the cut slit 12*b* of the knocking cap or the cut slit 11*d* of the eraser receiving base is elastically deformed in a direction of spreading a diameter, whereby the projection 11*a* can be easily inserted into the guide groove 12*a* from inside, and after insertion, the cut slit 12*b* or 11*d* is elastically restored in a direction of reducing a diameter. Thereby, the projection 11*a* and the guide groove 12*a* are positively engaged.

Then, after the knocking cap has been inserted into the rear cap 7 from the rear end, the inserting element 15*a* of the clip 15 is pressed into the clip inserting groove 7*c* of the rear cap 7.

Thereafter, the front end engaging projection 94 integrally projected on the outer peripheral surface of the front end of the connection shaft portion 93 is adjusted to the axial sliding groove 85 of the connector 8, and elastically deformed in a direction of reducing a diameter by utilizing the cut slit 92. The projection 94 is then fitted and connected to the axial sliding groove 85, and the intermediate ring 6 is inserted into the connector 8 from the frontward side.

When the spiral member 9 comes into contact with the inward engaging pawl 11*b* provided on the inner peripheral surface on the front end side of the eraser base 11, 11', 11 connector 8 is rotatively fed.

The tubular portion 6*c* at the rear of the intermediate ring 6 being inserted into the connector 8 is screwed into the front end of the rear cap 7 whereby they are integrally unified.

The tubular portion 6*b* frontwardly of the intermediate ring 6 is fitted into the rear end of the outer tube 1 while inserting the rear end of the lead pipe 4 extended from the rear end of the outer tube 1 into the front-stage tubular portion 80 of the connector 8 projected from the fore end of the rear cap 7 whereby the outer tube 1 and the rear cap 7 are rotatably connected to complete an assembly of the writing instrument.

Accordingly, when the rear cap 7 is removed from the outer tube 1, the cap 5 at the rear of the lead pipe 4 is exposed, and therefore, the cap 5 can be removed to thereby easily replenish the lead S for the lead pipe 4.

The operation will be described hereinafter. When the rear cap 7 is rotated in one direction with the eraser 13 withdrawn into the rear cap 7, the eraser receiving base is integrally rotated through the knocking cap, whereby the inward engaging pawl 11*c* of the eraser receiving base is guided by the spiral groove 95 of the spiral member 9 and the eraser receiving base is moved backward within the knocking cap.

Thereby, the eraser 13 is fed out from the rear end of the knocking cap to erase a letter etc.

When the rear cap 7 is then rotated in the opposite direction, the eraser receiving base is rotated therewith and the inward engaging pawl 11*b* is guided by the spiral groove 95 and moved forward, whereby the eraser 13 is withdrawn into the knocking cap.

In either state in which the eraser 13 is projected or withdrawn, when the knocking cap is knocked, the spiral member 9 is moved forward through the stopper shoulder 91 in engagement with the fore end of the knocking cap.

The lead pipe 4 is forced forward through the cap 5 at the front end of the spiral shaft portion 90 whereby the lead draw-out mechanism is actuated to sequentially feed the end pipe 30 and the lead S.

When the knocking cap is unknocked, the knocking cap is moved backward by the urging force of the elastic body 10 and the engaging projection 12*b* of the knocking cap engages the engaging portion 15*b* of the clip 15 whereby the knocking cap is maintained at a fixed rearwardly projected position.

As described above, according to this invention, the eraser guide member projected from the rear end of the rear cap rotatably connected to the rear end of the outer tube is knocked whereby the feeding of a lead can be accomplished smoothly, and the eraser guide member is rotated whereby the eraser can be moved in and out of the rear end of the eraser guide member. Therefore, the eraser can be drawn out according to the degree of consumption, which can be properly adjusted, and the eraser can be used for long periods. This provides an effect that the eraser may be very conveniently used. In addition, there is a further effect that the eraser guide member is always urged in a direction of withdrawal and maintained at a fixed withdrawl position during non-knocking whereby the eraser guide member having been lowered when the eraser is drawn out is not moved therewith, and such movement can be positively prevented.

Furthermore, according to this invention, there is an effect that the outer tube and the rear cap can be positively rotatably connected.

Moreover, according to this invention, there is an effect that the eraser can be positively and smoothly drawn out and withdrawn and in addition, assembling can be effected easily.

According to the invention, the revolution of the eraser guide member results in movement of the eraser receiving member in the axial direction. Thus, it is possible to propel or retract the eraser supported by the eraser receiving member and the propelling length of the eraser can be adjusted accordingly by adjusting the number of revolutions of the eraser.

In particular, the deformable portion of the eraser receiving member is deformed in the axial direction so as to absorb the play of the eraser guide member in the diametric direction and of the internal diameter of the rear cap because of the existence of a bend in the diametric direction of the protrusion of the eraser receiving member upon the revolving actuation of the eraser guide member. As a result, the propelling and retraction of the eraser can be performed more smoothly and precisely.

In addition, the bend of the eraser receiving member in the diametric direction can be absorbed by deformation of the deformable portion in the diametric direction so that there may be prevented the breakage of the projection of the eraser receiving member and of the eraser guide member due to the above bend. Thus, this invention can always provide such effect as a smooth propelling and retracting operation of the eraser.

What is claimed is:

1. A writing instrument comprising:

an outer tube into which a lead pipe is axially slidably inserted, said outer tube having a rear end of which inner peripheral surface is formed into a polygonal shape;

a connector having a fore end of which outer peripheral surface is formed into a polygonal shape, and a rear end, fitting detachably between said fore end of the connector and said rear end of the outer tube being attained by inserting said fore end of the connector into said rear end of the outer tube;

a rear cap to which said rear end of the connector is rotatably connected for rotatably connecting between said outer tube and said rear cap;

an eraser guide member axially slidably receivable within said rear cap, said eraser guide member having an axial guide groove formed therein;

an eraser receiving member axially slidably receivable within said eraser guide member for supporting an eraser, said eraser receiving member having a deformable portion deformable in a diametric direction, said deformable portion having an outward diametric projection formed thereon, said outward diametric projection being axially slidably receivable within said axial guide groove of said eraser guide member;

a spiral member contained in said rear cap and threadingly engageable of a diametric projection of said eraser receiving member, said spiral member being detachably connected to said outer tube through said connector for rotation with said outer tube relative to said rear cap.

2. A writing instrument comprising:

an outer tube into which a lead pipe is axially slidably inserted, said outer tube having a rear end of which inner peripheral surface if formed into a polygonal shape;

a connector including a fore end of which outer peripheral surface is formed into a polygonal shape, a rear end, and a middle-stage tubular portion on which an engaging projection and axial slits are provided along a perpendicular sectional line thereof, said engaging projection being brought into engagement with an engaging recess of said outer tube to provide fitting between said outer tube and said connector, fitting detachably between said fore end of the connector and said rear end of the outer tube being attained by inserting said fore end of the connector into said rear end of the outer tube;

a rear cap to which said rear end of the connector is rotatably connected for rotatably connecting between said outer tube and said rear cap;

an eraser guide member axially slidably receivable within said rear cap, said eraser guide member having an axial guide groove formed therein; and an eraser receiving member axially slidably receivable within said eraser guide member for supporting an erase, said eraser receiving member having a deformable portion deformable in a diametric direction, said deformable portion having an outward diametric projection formed thereon, said outward diametric projection being axially slidably receivable within said axial guide groove of said eraser guide member;

a spiral member receivable within said eraser receiving member and threadingly engageable of an inward diametric projection of said eraser receiving member, said spiral member being detachably connected to said outer tube through said connector for rotation with said outer tube relative to said rear cap.

* * * * *